United States Patent [19]

Miyafuji et al.

[11] 4,430,298

[45] Feb. 7, 1984

[54] COPPER ALLOYS FOR ELECTRIC AND ELECTRONIC DEVICES AND METHOD FOR PRODUCING SAME

[75] Inventors: Motohisa Miyafuji, Yamaguchi; Takashi Matsui, Shimonoseki; Hidekazu Harada, Shimonoseki; Masumitsu Soeda, Shimonoseki; Shin Ishikawa, Shimonoseki; Hiroshi Murakado, Shimonoseki; Hiroaki Kawamoto, Shimonoseki; Takeo Tabuchi, Shimonoseki; Kunio Kamada, Shimonoseki; Yasuhiro Nakashima, Shimonoseki, all of Japan

[73] Assignee: Kabushiki Kaisha Kobe Seiko Sho, Kobe, Japan

[21] Appl. No.: 501,110

[22] Filed: Jun. 6, 1983

[30] Foreign Application Priority Data

Jun. 5, 1982 [JP] Japan ..... 57-96484

[51] Int. Cl.[3] ..... C22C 9/06

[52] U.S. Cl. ..... 420/481; 148/11.5 C; 420/482; 420/487

[58] Field of Search ..... 420/481, 482; 148/11.5 C, 434, 435

[56] References Cited

U.S. PATENT DOCUMENTS

| | | | |
|---|---|---|---|
| 4,191,601 | 2/1980 | Edens et al. | 148/12.7 C |
| 4,337,089 | 6/1982 | Arita et al. | 148/11.5 C |
| 4,362,579 | 12/1982 | Tsuji | 420/481 |
| 4,366,117 | 12/1982 | Tsuji | 420/481 |

FOREIGN PATENT DOCUMENTS

| | | | |
|---|---|---|---|
| 2509892 | 9/1976 | Fed. Rep. of Germany | 420/481 |
| 53-19131 | 2/1978 | Japan | 420/487 |
| 56-116847 | 9/1981 | Japan | 420/487 |

*Primary Examiner*—Peter K. Skiff
*Attorney, Agent, or Firm*—Oblon, Fisher, Spivak, McClelland & Maier

[57] ABSTRACT

A copper alloy for electric and electronic devices, comprising: 3.0–3.5 wt % of Ni, 0.5–0.9 wt % of Si, 0.02–1.0 wt % of Mn, 0.1–5.0 wt % of Zn and the balance Cu and the inevitable impurities.

3 Claims, No Drawings

COPPER ALLOYS FOR ELECTRIC AND ELECTRONIC DEVICES AND METHOD FOR PRODUCING SAME

BACKGROUND OF THE INVENTION

1. Field of the Invention

This invention relates to copper alloys for electric and electronic devices and to a method for producing the same. More particularly, it relates to copper alloys for electric and electronic devices which have excellent resistance to the peeling of coated tin plating or tin alloy plating and to a method for producing the alloys.

2. Description of the Prior Art

In general, high strength and high conductivity copper alloys are suitable for use in the manufacture of electric and electronic devices. In particular, Cu-Ni-Si alloys satisfy characteristic requirements of alloys for use in the manufacture of such articles. Alloys for electric and electronic devices are manufactured with an applied tin plating or solder plating, said plating being made of a tin alloy. A problem with conventional tin alloy platings is that they peel or crack, which obviously lessens the reliability of the plated products. In view of this problem, alloy plated electric and electronic devices are subjected, for example, to a high temperature storage test after soldering, in which the soldered alloys are heated under the conditions of 150° C. for 500 hrs in air to determine the resistance of tin and solder platings to peeling. In spite of their high strength and high conductivity, the above-mentioned Cu-Ni-Si alloys possess the drawback that when they are subjected to the high temperature storage test after soldering, the solder is liable to peel. Thus, such alloys have heretofore experienced only limited use in the manufacture of electric and electronic devices.

In order to overcome the disadvantages of the conventional alloys, studies have been made in which a variety of elements have been added to Cu-Ni-Si alloys. As a results, it has now been found that incorporation of Zn with or without Cr is effective in improving the peeling resistance of such alloys. Moreover, it has also been found, as the result of X-ray diffraction analysis, that in Cu-Ni-Si alloys, precipitation of $Ni_2Si$ in large amounts contributes to improvement in the peeling resistance of the applied solder. Moreover, it has been ascertained that the annealing temperature of 400°–550° C. after cold working is the point at which $Ni_2Si$ precipitates at the highest level. The annealing time used was in the range of 5 minutes-4 hours.

Because Cu-Ni-Si alloys are of the precipitation hardening type, their cold workability is greatly influenced by the quenching conditions after hot working. Accordingly, quenching conditions have been investigated in order to improve productivity and to achieve stabilization of quality, with the result that it has been found that the quenching temperature should be over 600° C. with a cooling rate over 15° C. per second.

SUMMARY OF THE INVENTION

Accordingly, one object of the present invention is to provide an alloy for electric and electronic devices which impart improved peeling resistance to tin and tin alloy platings.

Briefly, this object and other objects of the present invention as hereinafter will become more readily apparent can be attained by a copper based alloy which in one embodiment has the alloy composition of 3.0–3.5 wt% Ni, 0.5–0.9 wt% Si, 0.02–1.0 wt% Mn, 0.1–5.0 wt% Zn and the balance Cu and the inevitable impurities. In a second embodiment of the alloy, the alloying ingredients additionally comprise from 0.005–0.1 wt% Cr.

DETAILED DESCRIPTION OF THE PREFERRED EMBODIMENTS

The present invention overcomes the disadvantage of ordinary Cu-Ni-Si alloys as substrates for tin and tin alloy platings which exhibit poor peeling resistance, and is based on the findings known from the results of the present investigation. The invention provides copper alloys for electric and electronic devices which exhibit excellent peeling resistance of the tin and tin alloy platings and also a method for producing such alloys.

The present copper alloys used in the manufacture of electric and electronic devices and the method for producing the alloys involve the following three embodiments:

(1) a first embodiment in which the copper alloy comprises 3.0–3.5 wt% of Ni, 0.5–0.9 wt% of Si, 0.02–1.0 wt% of Mn, 0.1–5.0 wt% of Zn and the balance Cu and the inevitable impurities; (2) a second embodiment in which the copper alloy comprises 3.0–3.5 wt% of Ni, 0.5–0.9 wt% of Si, 0.02–1.0 wt% of Mn, 0.1–5.0 wt% of Zn, 0.005–0.1 wt% of Cr and the balance Cu and the inevitable impurities; and (3) a third embodiment which is directed to a method of producing copper alloys for electric and electronic devices which is characterized by subjecting, to hot working, a copper alloy comprising 3.0–3.5 wt% of Ni, 0.5–0.9 wt% of Si, 0.02–1.0 wt% of Mn, 0.1–5.0 wt% of Zn, with or without 0.005–0.1 wt% of Cr, and the balance Cu and the inevitable impurities, cooling the alloy from temperatures over 600° C. at a rate of over 15° C. per second, and, after cold working, annealing the worked product at 400° C.–550° C. for 5 minutes-4 hours.

The composition of the present copper alloy is described in detail as follows:

Ni is an element which can impart strength to the alloy. If the Ni content of the alloy is less than 3.0 wt%, no improvement of strength can be expected even though Si is present within the range of 0.5–6.9 wt%. On the contrary, if the Ni content is over 3.5 wt%, no further effect can be expected with poor economy. Accordingly, the Ni content of the alloy is in the range of 3.0–3.5 wt%.

Si is an element which can improve the strength of the alloy similar to Ni. Amounts of the element less than 0.5 wt% do not contribute to improved strength even though Ni is present with the range of 3.0–3.5 wt%. Amounts of Si exceeding 0.9 wt% are disadvantageous in decreasing the conductivity of the alloy and also result in deterioration of the hot workability of the alloy. Accordingly, the Si content should be within the range of 0.5–0.9 wt%.

Mn is an element which can improve the hot workability of the alloy. If its content is less than 0.02 wt%, this improved effect is reduced. On the contrary, if the Mn content exceeds 1.0 wt%, the casting flowability deteriorates with a considerable lowering of casting yield. Accordingly, the content of Mn should be within the range of 0.02–1.0 wt%. In order not to suffer losses in electric conductivity, however, the content of Mn should be within the preferred range of 0.02–0.1 wt%.

Zn is an element which can remarkably improve the peeling resistance of tin and tin alloy platings. If the content of Zn in the alloy is less than 0.1 wt%, this effect is reduced, whereas if the content is larger than 5.0 wt%, the solderability of the alloy deteriorates. Accordingly, the content of Zn in the alloy should be within the range of 0.1–5.0 wt%.

Cr is an element which exerts good influence on the peeling resistance of tin and tin alloy platings similar to Zn. However, if Cr is used singly, the same effect as achieved by the use of Zn alone cannot be attained. In other words, even though Zn is present in an amount of 0.1–5.0 wt% in the alloy, its effect will be reduced if the content of Cr is less than 0.005 wt%. If, on the other hand, Cr is present in excess of 0.1 wt%, the casting flowability of the alloy considerably deteriorates with an attendant deterioration of casting yield. Accordingly, the content of Cr should be within the range of 0.005–0.1 wt%.

An embodiment of the method of preparation of the alloy is as follows.

A casting obtained by an ordinary ingot technique is subject to hot working, after which it is cooled from temperatures over 600° C. at a cooling rate of 15° C./second. For temperatures less than 600° C., even though the cooling rate employed is over 15° C./second, precipitation hardening will already have taken place in the material, which worsens the cold workability of the alloy in a subsequent step. On the other hand, if the cooling rate is less than 15° C./second, even though the starting temperature is over 600° C., precipitation hardening likewise occurs. Accordingly, the quenching temperature should be over 600° C. and the cooling rate should be over 15° C./second.

Annealing after cold working imparts the effect of imparting peeling resistance to the tin and tin alloy platings. It has been confirmed by X-ray analysis that peeling of tin or tin alloy coatings becomes considerable when precipitation of $Ni_2Si$ is small in amounts and when Ni and Si form a solid solution. With the copper alloys for electric and electronic devices according to the present invention, the temperature at which $Ni_2Si$ precipitates in the greatest amount by annealing after cold working, i.e. where the conductivity of the alloys becomes greatest, is 500° C. At temperatures less than 400° C., only reduced amounts of Ni and Si compounds precipitate. These solid solutions of Ni and Si exert an adverse effect on peeling resistance. Accordingly, the annealing temperature should be within the range of 400° C.–550° C. If the annealing time is less than 5 minutes, precipitation is insufficient, whereas a time period of over 4 hours is not advantageous from the standpoint of thermal economy. Accordingly, the annealing temperature should be within the range of 400° C.–550° C. and the annealing time should be within the range of 5 minutes-4 hours.

Having generally described this invention, a further understanding can be obtained by reference to certain specific examples which are provided herein for purposes of illustration only and are not intended to be limiting unless otherwise specified.

TABLE 1

| Example No. | Chemical Components (wt %) | | | | | | |
|---|---|---|---|---|---|---|---|
| | Ni | Si | Mn | Zn | Cr | Cu | Remarks |
| 1 | 3.24 | 0.67 | 0.029 | 0.10 | — | balance | Inventive alloy |

TABLE 1-continued

| Example No. | Chemical Components (wt %) | | | | | | |
|---|---|---|---|---|---|---|---|
| | Ni | Si | Mn | Zn | Cr | Cu | Remarks |
| 2 | 3.28 | 0.69 | 0.038 | 0.21 | — | balance | Inventive alloy |
| 3 | 3.28 | 0.69 | 0.038 | 0.46 | — | balance | Inventive alloy |
| 4 | 3.28 | 0.68 | 0.040 | 0.20 | 0.05 | balance | Inventive alloy |
| 5 | 3.28 | 0.69 | 0.034 | — | — | balance | Comparative alloy |
| 6 | 3.26 | 0.68 | 0.038 | 0.05 | — | balance | Comparative alloy |
| 7 | 3.28 | 0.68 | 0.023 | 5.06 | — | balance | Comparative alloy |
| 8 | 3.22 | 0.67 | 0.038 | — | 0.04 | balance | Comparative alloy |

Ingots having the alloy components and their contents indicated in Table 1 are produced by the following procedure.

Highly pure Cu is melted in an electric furnace while covered with charcoal at a temperature of about 1200° C. About 20% of the Cu charge is left and Ni is charged into the alloy in such an amount that a predetermined content of Ni is attained. After melting, Si is charged and, if desired, Cr is further added as an intermediate alloy of Cu-10 wt% Cr. After these starting materials have melted down, the balance of the Cu is charged and the molten metal temperature is decreased to 1180° C.–1190° C., followed by the addition of Zn, and casting of the molten alloy into a mold to obtain a 50 mm thick×80 mm wide×130 mm long ingot after surface milling.

These ingots are heated to 850° C. and hot worked to a thickness of 15 mm, followed by charging of the ingot into water from 700° C. At this time, the cooling rate is 30° C./second. Thereafter, cold working is effected to a level of 0.5 mm, followed by annealing at 500° C. for 2 hours for the subsequent soldering test.

PREPARATION OF SAMPLES IS DESCRIBED

The annealed materials are each cut into pieces 0.5 mm thick×25 mm wide×50 mm long, and are polished with Scotch bright, followed by subjection of the polished pieces to electrolytic abrasion and soldering with tin alloy according to the MIL STD-202E method 208C. The soldered samples are subjected to the high temperature storage test.

The storage conditions involve heating under conditions of 150° C. at 500 hrs in the air. The samples were then evaluated for peeling resistance by bending the soldered portion at 180° and then bending the piece back to its original state. The peeling resistance of the alloy is then evaluated by stripping the tape sticked on the alloy.

In Table 2, the soldering properties of the alloys of the present invention are shown as well as the same properties of comparative alloys. In Table 3, the results of peeling resistance tests after high temperature storage are shown.

TABLE 2

| Test | Conditions | Sample No. | Solderability | Remarks |
|---|---|---|---|---|
| Solderability | MIL-STD-202E Method 208C | 1 | Good | Inventive alloy |
| | | 2 | Good | Inventive alloy |

TABLE 2-continued

| Test | Conditions | Sample No. | Solder-ability | Remarks |
|---|---|---|---|---|
| Test | Solder: 60Sn/40Pb | 3 | Good | Inventive alloy |
| | Temperature: 230° C. | 4 | Good | Inventive alloy |
| | | 5 | Good | Comparative alloy |
| | | 6 | Good | Comparative alloy |
| | | 7 | Poor | Comparative alloy |
| | | 8 | Good | Comparative alloy |

TABLE 3

| Test | Conditions | Sample No. | Peeling of Solder Plating | Remarks |
|---|---|---|---|---|
| High | 150° C. | 1 | Not peeled | Inventive alloy |
| Temp. | 500 hrs | 2 | " | Inventive alloy |
| Storage | Heating in | 3 | " | Inventive alloy |
| Test | Air | 4 | " | Inventive alloy |
| | | 5 | Peeled | Comparative alloy |
| | | 6 | Partly peeled | Comparative alloy |
| | | 7 | Not peeled | Comparative alloy |
| | | 8 | Partly peeled | Comparative alloy |

As will become apparent from the results of Tables 2 and 3, the copper alloys according to the present invention exhibit good soldering properties and involve no peeling of solder. Thus, the alloys prove to be very reliable and are satisfactory for use in the manufacture of electric and electronic devices.

An embodiment of the present method for producing the copper alloys of the invention is described as follows along with comparative examples.

Copper alloy No. 2 shown in Table 1 is hot worked at 850° C. from 50 mm to 15 mm and then quenched at 700° C. The cooling rate is 30° C./second. Thereafter, the alloy is cold worked to 0.5 mm and annealed at 375° C. and at temperatures ranging from 400° C. to 600° C. at intervals of 50° C. for 2 hours. It will be noted that short time annealing at 500° C. for 3 minutes is effected and the annealed samples are subjected to the high temperature storage test. The preparation of samples, soldering and evaluation are carried out in the same manner as described before.

In Table 4, the peeling resistance of the solder prepared by the method of the present invention is shown with respect to an alloy of the same composition but prepared by the indicated comparative example.

TABLE 4

| Test | Conditions | Anneal-ing Temp. | Anneal-ing Time | Peel-ing of Solder | Remarks |
|---|---|---|---|---|---|
| High | 150° C. | 450° C. | 2 hrs | Not peeled | Method of invention |
| Temp. | 500 hrs | 500° C. | " | Not peeled | Method of invention |
| Stor-age | Heating | 550° C. | " | Not peeled | Method of invention |
| Test | in Air | 500° C. | 3 min | Partly peeled | Comparative method |
| | | 375° C. | 2 hrs | Peeled | Comparative method |
| | | 600° C. | 2 hrs | Partly peeled | Comparative method |

As is apparent from Table 4, the method of the present invention can produce copper alloys as substrates for solder layers which do not exhibit peeling, and thus the present alloys are highly reliable and satisfactory for use in the manufacture of electric and electronic devices. In order to obtain the intended mechanical strength after annealing, the method of the present invention may include, after cold working, tension annealing or AP line (continuous annealing and pickling line) for the purpose of correcting strains.

It will be noted that plating or coating may be effected by any suitable technique such as an electrochemical technique, dipping or vacuum deposition.

As will be appreciated from the foregoing, the copper alloys of the present invention and the method of preparation result in a product whose outstanding feature is that no peeling of tin and tin alloy platings (solder platings) is involved and the alloys are very suitable when used for the manufacture of electric and electronic devices.

Having now fully described the invention, it will be apparent to one of ordinary skill in the art that many changes and modifications can be made thereto without departing from the spirit or scope of the invention as set forth herein.

What is claimed as new and desired to be secured by Letters Patent is:

1. A copper alloy for electric and electronic devices, comprising: 3.0–3.5 wt% of Ni, 0.5–0.9 wt% of Si, 0.02–1.0 wt% of Mn, 0.1–5.0 wt% of Zn and the balance Cu and the inevitable impurities.

2. A copper alloy for electric and electronic devices, comprising: 3.0–3.5 wt% of Ni, 0.5–0.9 wt% of Si, 0.02–1.0 wt% of Mn, 0.1–5.0 wt% of Zn, 0.005–0.1 wt% of Cr, and the balance Cu and the inevitable impurities.

3. A method for producing a copper alloy for electric and electronic devices, comprising the steps of:

(a) subjecting to hot working a copper alloy which comprises 3.0–3.5 wt% of Ni, 0.5–0.9 wt% of Si, 0.02–1.0 wt% of Mn, 0.1–5.0 wt% of Zn, optionally containing 0.005–0.1 wt% of Cr, and the balance Cu and the inevitable impurities;

(b) cooling the alloy at a rate of over 15° C. per second from a temperature exceeding 600° C.; and (c) after cold working, annealing the alloy at 400° C.–550° C. for 5 minutes to 4 hours.

* * * * *

UNITED STATES PATENT AND TRADEMARK OFFICE

CERTIFICATE OF CORRECTION

PATENT NO. : 4,430,298

DATED : FEBRUARY 7, 1984

INVENTOR(S) : MOTOHISA MIYAFUJI ET AL

It is certified that error appears in the above-identified patent and that said Letters Patent is hereby corrected as shown below:

Column 1, line 40, delete "results" and insert therefore --result--.

Column 2, line 45, delete "0.5-6.9" and insert therefore --0.5-0.9--.

Column 2, line 67, delete "electric" and insert therefore --electrical--.

Column 4, line 53, after "180°" insert --C--.

Signed and Sealed this

*Twenty-first* Day of *August 1984*

[SEAL]

*Attest:*

GERALD J. MOSSINGHOFF

*Attesting Officer*

*Commissioner of Patents and Trademarks*